US005250494A

United States Patent [19]

Wehrmann et al.

[11] Patent Number: 5,250,494

[45] Date of Patent: Oct. 5, 1993

[54] DYE ACCEPTOR ELEMENT FOR THE THERMAL SUBLIMATION PRINTING PROCESS

[75] Inventors: Rolf Wehrmann, Krefeld, Fed. Rep. of Germany; Hermann Uytterhoeven, Bonheiden, Belgium; Richard Weider, Leverkusen, Fed. Rep. of Germany

[73] Assignee: AGFA-Gevaert Aktiengesellschaft, Leverkusen, Fed. Rep. of Germany

[21] Appl. No.: 773,036

[22] Filed: Oct. 8, 1991

[30] Foreign Application Priority Data

Oct. 17, 1990 [EP] European Pat. Off. ..... 90202759
Aug. 28, 1991 [EP] European Pat. Off. ..... 91114420

[51] Int. Cl.[5] ..... B41M 5/035; B41M 5/38

[52] U.S. Cl. ..... 503/227; 428/195; 428/480; 428/913; 428/914; 528/272; 528/295.3; 528/302; 528/303; 528/308

[58] Field of Search ..... 8/471; 428/195, 480, 428/913, 914; 503/227; 528/272, 295.3, 302, 303, 308

[56] References Cited

U.S. PATENT DOCUMENTS 4,990,485 2/1991 Egashira et al. ..... 503/227

*Primary Examiner*—B. Hamilton Hess
*Attorney, Agent, or Firm*—Connolly & Hutz

[57] ABSTRACT

A dye acceptor element for the thermal sublimation printing process, having a base and a dye acceptor layer which contains a polyester formed from diols and dicarboxylic acids, the diol component of the polyester consisting to the extent of 0.5 to 60 mol% of a dimer diol, is distinguished by a high color density and a low tendency to sticking.

8 Claims, No Drawings

DYE ACCEPTOR ELEMENT FOR THE THERMAL SUBLIMATION PRINTING PROCESS

The present invention relates to a dye acceptor element for the thermal sublimation printing process.

A number of methods exists for making print-outs of video- or computer-stored images, of which methods the thermal sublimation printing process has, due to its advantages, proved to be superior to other processes in the case of certain requirements. In this recording method, a sheet- or strip-like donor material, which contains a sublimable dyestuff, is contacted with a dye(-stuff) acceptor layer and heated imagewise for transferring the dyestuff.

The driving of the thermal head and the transfer of the dyestuff from the donor material to the acceptor element takes place in accordance with the stored original. A detailed description of the process is given, for example, in "High Quality Image Recording by Sublimation Transfer Recording Material", Electronic Photography Association Documents 27 (2), 1988, and in the literature quoted therein. A particular advantage of this printing process is the possibility of a fine gradation of the colour intensities.

Dye acceptor elements for thermal sublimation printing usually comprise a base, for example paper or transparent films, which is coated with the actual dye acceptor layer. An adhesion layer can be provided between the base and the acceptor layer.

Polymers from various classes of substances can be used as the material for the dye acceptor layer. Thus, the following examples of suitable materials for the acceptor layer are mentioned in EP-A-0,234,563:

1. Synthetic resins with ester compounds, such as polyesters, polyacrylates, polyvinyl acetate, styrene/acrylate resins and vinyltoluene/acrylate resins
2. Polyurethanes
3. Polyamides
4. Urea resins
5. Synthetic resins with other highly polar bonds, such as polycaprolactam, styrene resins, polyvinyl chloride, vinyl chloride/vinyl acetate copolymers and polyacrylonitrile.

(Co)polyesters are a frequently used binder. They are obtained by reacting one or more dicarboxylic acids with one or more diols. Preferably, at least one dicarboxylic acid and/or one diol contains aromatic groups, in order to ensure that the glass temperature Tg of the polycondensate is at least 0° C., and preferably at least 10° C.

Such polyesters are described, for example, in EP-A-0,289,161, EP-A-0,275,319, EP-A-0,261,505, EP-A-0,368,318, JP 86/3796 or JP 269,589.

The dye acceptor layers available at present do not yet meet the requirements for high colour density, adequate image stability and good resolution to a sufficient degree. It is particularly difficult here to achieve a high colour density and adequate image stability, coupled with a minimum of lateral diffusion. Moreover, sticking between the donor strip and the acceptor element can occur during the printing step, and this leads to blurred images. Sliding layers or lubricants are therefore frequently used.

It was the object of the invention to provide a dye acceptor element for the thermal sublimation printing process, which does not have the abovementioned disadvantages. The object is achieved by the use of a specific polymer in the dye acceptor element.

A dye acceptor element for the thermal sublimation printing process has now been found which has very high dyeability, very good sliding properties and good image stability and is based on a polyester of a specific structure.

The present invention relates to a dye acceptor element for the thermal sublimation printing process, having a base and a dye acceptor layer which is located thereon and contains a polyester formed from diols and dicarboxylic acids, characterised in that 0.5 to 60 mol% of the diol component of the polyester consists of a dimer diol.

Dimer diols are dialkyl-substituted diols having 24 or more carbon atoms and optionally containing a saturated, unsaturated or aromatic carbocyclic ring, which diols are obtainable by hydrogenation from so-called dimer fatty acids ("dimeric acids").

The latter are dimerisation products of unsaturated aliphatic carboxylic acids (fatty acids) having 12 or more carbon atoms, preferably of unsaturated $C_{18}$-fatty acids such as oleic acid and linoleic acid. Dimer acids are described, for example, in Ullmann's Encyclopedia of Industrial Chemistry, 5th Edition, Volume A8, page 535. They are in general in the form of a mixture.

Suitable dimer diols can be described for example, as mixtures of compounds of the general formulae I, II and III

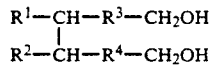

I

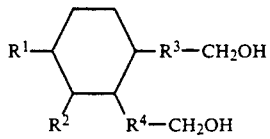

II

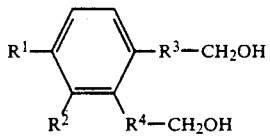

III in which $R^1$ and $R^2$represent alkyl and $R^3$and $R^4$ represent alkylene, with the proviso that $R^1$, $R^2$, $R^3$ and $R^4$ together contain 40, 36, 32, 28, 24 or 20 carbon atoms in the formula I, and 36, 32, 28, 24, 20 or 16 carbon atoms in the formulae II and III. Such diols can be obtained, for example, from unsaturated $C_{22}$-fatty acids (upper limit value) or unsaturated $C_{12}$-fatty acids (lower limit value). Preferably, $C_{16}$- and $C_{18}$-fatty acids are used.

Such product mixtures are obtainable, for example, from the company Unichema GmbH, Emmerich, under the product name Pripol 2033.

The polyesters according to the invention can be prepared by condensation reactions of one or more dicarboxylic acids with one or more diols, including dicarboxylic acids and diols containing aromatic groups, and the dimer diols. Derivatives of the acids—for example esters, acid chlorides and the like—and of the diols—for example acetates—can also be used for the condensation.

Examples of dicarboxylic acids which may be mentioned are oxalic acid, malonic acid, succinic acid, glutaric acid, adipic acid, azelaic acid, sebacic acid, decane-1,10-dicarboxylic acid, undecane-1,11-dicarboxylic acid, dodecane-1,12-dicarboxylic acid, tridecane-1,13-dicarboxylic acid, tetradecane-1,14-dicarboxylic acid and the like or dimer fatty acids or derivatives thereof (Unichema), cyclohexanedicarboxylic acid, maleic acid, maleic anhydride, fumaric acid, itaconic acid, phthalic acid, isophthalic acid, terephthalic acid, toluenedicarboxylic acids, naphthalenedicarboxylic acids and sulphoisophthalic acid, and especially alkyl- or alkenyl-substituted dicarboxylic acids having not more than 5 carbon atoms in the main chain between the carboxyl groups and at least 6 carbon atoms in a side chain. Examples of the last-mentioned alkyl- or alkenyl-substituted dicarboxylic acids are tetradecylmalonic acid, hexadecylmalonic acid, octadecylmalonic acid, diheptylmalonic acid, octylsuccinic acid, decylsuccinic acid, dodecylsuccinic acid, tetradecylsuccinic acid, hexadecylsuccinic acid, octadecylsuccinic acid, octenylsuccinic acid, isooctenylsuccinic acid, decenylsuccinic acid, dodecenylsuccinic acid, tetradecenylsuccinic acid, hexadecenylsuccinic acid, octadecenylsuccinic acid, docosylsuccinic acid, docosenylsuccinic acid, tetrapropenylsuccinic acid, triacontenylsuccinic acid, polyisobutenylsuccinic acid, 1-dodecylglutaric acid, 1-tetradecylglutaric acid, 1-hexadecylglutaric acid and 1-decyladipic acid. Amongst these, hexadecylmalonic acid, octadecylmalonic acid, hexadecylsuccinic acid, octadecylsuccinic acid and docosenylsuccinic acid are particularly preferred.

The diols used can be ethylene glycol, diethylene glycol, triethylene glycol, neopentyl glycol, butane-1,4-diol, propane-1,2-diol, propane-1,3-diol, hexane-1,6-diol, hexane-1,2-diol, cyclohexane-1,4-diol, cyclohexane-1,4-dimethanol, ethoxylated or propoxylated bisphenols such as dianol 22 (ethoxylated BPA, Akzo), dianol 33 (propoxylated BPA, Akzo) or ethoxylated or propoxylated hydroquinone. Long-chain diols such as octane-1,8-diol, nonane-1,9-diol, decane-1,10-diol, undecane-1,11-diol, dodecane-1,12-diol and tridecane-1,13-diol can also be used, and also short-chain diols, especially those provided with at least one side chain, which contain not more than 5 carbon atoms between the two hydroxyl groups and an alkyl radical or alkenyl radical having at least 6 carbon atoms in the side chain. The long-chain alkyl radical or alkenyl radical of the side chain can be bound to the main chain directly or via linking members such as aromatic groups, cycloaliphatic groups or heteroatoms (for example —O—, —NH—, —O—CO—, —NH—CO—). Examples of the last mentioned short-chain diols provided with a side chain are octane-1,2-diol, decane-1,2-diol, dodecane-1,2-diol, hexadecane-1,2-diol, octadecane-1,4-diol, N,N-di(n-decyl)-aminopropane-2,3-diol, partial esters of glycerol and pentaerythritol, such as glycerol monostearate, glycerol monooleate, glycerol monoricinoleate, glycerol monolaurate, glycerol monocaprylate, pentaerythritol distearate,,and pentadecylresorcinol. Amongst these, dodecane-1,2-diol, hexadecane-1,2-diol, glycerol monostearate, glycerol monooleate and pentaerythritol distearate are particularly preferred.

Furthermore, the polyester according to the invention, formed from dicarboxylic acids and diols, can contain incorporated radicals of hydroxyalkanecarboxylic acids, especially of those which contain a side chain having preferably at least 8 carbon atoms. Suitable examples of these are hydroxybutyric acid, hydroxydecanoic acid, hydroxydodecanoic acid, hydroxyhexadecanoic acid, hydroxyoctadecanoic acid, methyl-n-hexylglycolic acid, 2,3-dihydroxynonanoic acid, 11-hydroxyundecanoic acid, 2-hydroxy-4,6,6-trimethylheptanoic acid, 16-hydroxyhexadecanoic acid, 12-hydroxystearic acid, 12-hydroxy-9-octadecenoic acid (ricinoleic acid) and 12,13-ethoxy-9-octadecenoic acid.

The dimer diol content is between 0.5 and 60, preferably between 1 and 30 and particularly preferably between 1.5 and 20 mol% of the total diol components.

The polyesters according to the invention have molecular weights between 500 and 20,000, preferably between 750 and 15,000 and particularly preferably between 1000 and 12,000, in each case determined by gel permeation chromatography using polystyrene as standard.

A higher solubility in polar solvents or solvent mixtures such as, for example, water, water/ethanol or water/MEK, can be obtained by using building blocks which contain hydrophilic (polar) groups such as, for example, sulphonic acid groups (example: sulphoisophthalic acid).

The polyester resins according to the invention form the essential constituents in the dye acceptor layer according to the invention. They can also be used as a mixture with other known resins for dye acceptor layers and, in this case, they are present in the dye acceptor layer in a quantity of at least 2% by weight, preferably at least 5% by weight; the following polymers a) to f) can be used alone or as a mixture of a plurality of them as the admixed polymers.

a) Polymers which contain ester bonds: for example polyesters, polyacrylic esters, polycarbonates, polyvinyl acetate, polyvinyl propionate, styrene/acrylates, methylstyrene/acrylates.

b) Polymers which contain urethane bonds: for example polyurethanes, polyester-urethanes.

c) Polymers which contain amide bonds: for example polyamides, polyester-amides.

d) Polymers which contain urea bonds: for example polyureas.

e) Polymers which contain other highly polar bonds, such as, for example, polycaprolactone, polystyrenes, polyvinyl alcohol, polyvinyl chloride, polyacrylonitrile, polyethers, polysulphones, polyether-ketones, polyhydantoin, polyamides, styrene/maleic anhydride copolymers, cellulose derivatives.

f) Polymers which contain functional groups optionally capable of crosslinking reactions, such as, for example, —OH, —$NH_2$, —NHR, —COOH, —SH, —NCO,

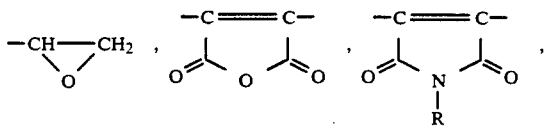

and polymers which have been obtained by cross-linking reactions from prepolymers containing such groups.

Examples of such resins are described, for example, in EP-A-0,227,094, EP-A-0,228,066, EP-A-0,133,011, EP-A-0,133,012, EP-A-0,144,247 or EP-A-0,368,320.

For example for increasing the image sharpness or for improving the whiteness, pigments or mixtures of a plurality of pigments, such as, for example, titanium dioxide, zinc oxide, kaolin, clay, calcium carbonate or Aerosil, can be added to the dye acceptor layer.

For a further increase in the light stability of the transferred image, various types of additives such as, for example, UV absorbers, light stabilisers or antioxidants, can be added if necessary.

The dye acceptor layers of the present invention can contain a lubricant for improving the sliding properties, mainly between the donor element and acceptor element. For example, solid waxes such as polyethylene wax, amide-type waxes or Teflon powders can be used, and also, if appropriate, fluorine-containing surfactants, paraffin-, silicone- or fluorine-containing oils or silicone-containing copolymers such as polysiloxane/-polyether copolymers. Reactive, modified silicones can also be used. Such products can contain carboxyl groups, amino groups and/or epoxide groups and, in an appropriate combination of, for example, aminosilicone and epoxysilicone, lead to crosslinked sliding layers.

The said lubricant can also be applied as a separate coating, as a dispersion or from a suitable solvent, optionally as a topcoat. The thickness of such a layer is then preferably 0.01 to 5 μm, particularly preferably between 0.05 and 2 μm.

Various materials can be used as the base for the dye acceptor layers. It is possible to use transparent films such as, for example, films of polyethylene terephthalate, polycarbonate, polyether-sulphone, polyolefin, polyvinyl chloride, polystyrene, cellulose or polyvinyl alcohol copolymers. Of course, reflective substrates such as the most diverse types of papers such as, for example, polyolefin-coated paper or pigmented papers are also used. Laminates of the abovementioned materials are also applicable. Typical combinations are represented by laminates of cellulose paper and synthetic paper or cellulose paper and polymer films or polymer films and synthetic paper or also further combinations.

The bases ensure the necessary mechanical stability of the dye acceptor element. If the dye acceptor layer has a sufficient mechanical stability, an additional base can be omitted.

The dye acceptor layers of the present invention have preferably total layer thicknesses from 0.3 to 50 μm, particularly preferably from 0.5 to 10 μm, if a base of the type described above is used, or, if this is omitted, from 3 to 120 μm. The dye acceptor layer can consist of a single layer, but two or more layers can also be applied to the base. If transparent bases are used, coating on both sides can be carried out in order to increase the colour intensity, as described, for example, in European Patent Application 90 200 930.7.

The dye acceptor element of the present invention can also contain various interlayers between the base and the dyestuff receiving layer. Depending on the specific properties of the material used, the interlayer can act as a resilient element (elastic layer), as a barrier layer for the transferred dyestuff or also as an adhesion layer, in each case depending on the specific application. Examples of suitable materials are urethane resins, acrylate resins or olefin resins, and also butadiene rubbers or epoxides. The thickness of this interlayer is usually between about 1 to 2 and 20 μm. Diffusion barrier layers have the object of preventing diffusion of the transferred dyestuffs into the base. Materials which meet this object can be soluble in water or in organic solvents or in mixtures, but preferably in water. Examples of suitable materials are gelatine, polyacrylic acid, maleic anhydride copolymers, polyvinyl alcohol or cellulose acetate.

The optionally present additional layers, such as an elastic layer, diffusion barrier layer, adhesion layer and the like, as well as the actual dye acceptor layer can contain, for example, silicate powder, clay powder, aluminium silicate powder, calcium carbonate powder, calcium sulphate powder, barium sulphate powder, titanium dioxide powder and alumina powder.

The dye acceptor element of the present invention can also have been provided with an antistatic finish in the usual manner on the front or back.

The dye acceptor layers containing the polyester resins according to the invention are usually prepared from solution. Examples of suitable solvents are water, methyl ethyl ketone (MEK), butyl acetate, acetone, alcohols or solvent mixtures such as, for example, MEK/water or ethanol/water. The solution can be applied to the base by casting or by blade application.

The dye acceptor element according to the invention is suitable for producing dyestuff transfer images. For this purpose, a dye acceptor element is contacted on the coating side with a dye donor element and the latter is heated imagewise from the back. The dyestuff transfer is effected by heating to about 400° C. for a few milliseconds.

The imagewise heating of the dye donor layer is usually effected by means of a commercially available thermal printing head (thermal head) in a thermal sublimation printer. However, the heat energy required for the dyestuff transfer can also be supplied by laser light, IR flash exposure or by means of a heated pen. If necessary, the dyestuff layer or another layer of the donor element contains agents which absorb light and convert it into heat, for example carbon black. The imagewise heating can also be effected by means of the known resistive-ribbon technology. In this case, the base of the donor element is, for example, a strip-shaped polycarbonate layer which is charged with carbon black and coated with a thin aluminium film and to which electric current is supplied imagewise by electrical activation of a print head electrode, whereby heat is generated in the resistive ribbon. Since the print head electrode itself hardly heats up during this step, this technology has an advantageous effect on the printing speed.

A multi-colour image can be produced in such a way that the dye acceptor element according to the invention is contacted successively with each of three or more donor elements having different dyestuffs, receives an image-wise dyestuff transfer in the particular colour from the donor element by imagewise heating of the latter and is separated again from the latter. Instead of a plurality of donor elements dyed in different colours, it is also possible to use a single donor element which contains the various dyestuffs in different zones.

In order to ensure accurate positioning during the printing step, required in this case, the dye acceptor element and/or donor element can be provided with visually detectable markings.

The dye images obtained by means of the dye acceptor element according to the invention are distinguished by high resolution, high colour densities, high brilliance and good long-term stability.

EXAMPLES

The polyester resins according to the invention are prepared in a conventional condensation apparatus under normal reaction conditions.

The preparation procedure is explained in more detail by the following example.

Polyester I 96.48 g (45 mol%) of dimethyl terephthalate, 96.48 g (45 mol%) of dimethyl isophthalate, 34.43 g (10 mol%) of the Na salt of dimethyl sulphoisophthalate, 71.95 g (105 mol%) of ethylene glycol, 69.86 g (20 mol%) of dianol 22, 30.81 g (5 mol%) of dimer diol 2033 and 0.1 g of titanium tetrabutylate are first introduced and heated under $N_2$ from room temperature to 220° C. and boiled for 1 hour under reflux. Subsequently, distillate is taken off for 1 hour and the bath temperature is increased stepwise to 280° C., and stirring is continued for 1 hour at this temperature. The final condensation takes place over the course of 2 hours at 280° C. while an oil pump vacuum is applied. The resin is isolated by pouring out the melt. The ethanediol, which is in excess corresponding to the stoichiometry indicated above, is separated off by distillation in the course of the condensation, so that there are almost equivalent molar quantities of acid groups and alcohol groups.

In accordance with the preparation procedure described above, polyesters 1–6 as indicated in Table 1 were prepared (data in mol%, relative to the total dicarboxylic acid component = 100 mol%).

TABLE 1

| Polyester | 1 | 2 | 3 | 4 | 5 | 6 |
|---|---|---|---|---|---|---|
| TPSE | 45 | 45 | 45 | 45 | 45 | 45 |
| IPSE | 45 | 42.5 | 42.5 | 42.5 | 42.5 | 42.5 |
| SIPSE | 10 | 12.5 | 12.5 | 12.5 | 12.5 | 12.5 |
| Ethanediol | 105 | 105 | 105 | | | |
| Dianol 22 | 20 | 20 | 20 | | | |
| Pripol 2083 | 5 | 2 | 2 | 5 | 5 | 7.5 |
| Edenor PES | | 3 | | | 5 | |
| Edenor GMS | | | 3 | 5 | | |
| Neopentyl glycol | | | | 45 | 45 | 35 |
| Cyclohexane-dimethanol | | | | 45 | 45 | 25 |
| TCD-DM | | | | | | 32.5 |
| % strength of the solution | 25 | 25 | 25 | 10 | 10 | 20 |
| Wet film thickness in μm | 20 | 20 | 20 | 25 | 25 | 20 |

In the table:
TPSE denotes dimethyl terephthalate
IPSE denotes dimethyl isophthalate
SIPSE denotes Na salt of dimethyl sulphoisophthalate
Dianol 22 denotes ethoxylated BPA (Akzo)

In the table:
TPSE denotes dimethyl terephthalate
IPSE denotes dimethyl isophthalate
SIPSE denotes Na salt of dimethyl sulphoisophthalate
Dianol 22 denotes ethoxylated BPA (Akzo)
Pripol 2033 denotes dimer diol (Unichema)
Edenor PES denotes a partial ester of pentaerythritol (Henkel)
Edenor GMS denotes glycerol monostearate (Henkel)
TCD-DM denotes tricyclodecanedimethanol.

Polyester resins 1–6 were dissolved in water/MEK (8:2) corresponding to the concentration indicated in Table 1 and cast by means of a blade in a wet film thickness of 20 μm or 25 μm (see Table 1) onto a paper which was coated on both sides with polyethylene and to one side of which a gelatine layer had been additionally applied above the polyethylene. The polyester solution was applied to this side. The coatings were dried for 30 minutes at 70° C. in a circulating-air drying cabinet. A sample (a) was left uncoated in each case (no sliding layer). To one further sample (b) in each case, a 0.5% strength solution of Tego Glide 410 (made by Goldschmidt) in ethanol was applied in a wet film thickness of 24 μm and dried at 70° C. in the circulating-air drying cabinet. On the dyestuff receiving elements obtained, test images were produced by means of a Mitsubishi CP-100 E video printer, using the Mitsubishi dyestuff cassette CK-100 S.

The dyestuff acceptor layers which are built up from the polyesters according to the invention are distinguished by very high colour densities and a greatly reduced tendency to stick. Colour densities, which were determined by means of a Macbeth RD 919 densitometer, and the sticking behaviour are indicated in Table 2.

TABLE 2

| Sample | Colour density: Yellow (blue filter) | Magenta (green filter) | Cyan (red filter) | Black (without filter) | Sticking behaviour |
|---|---|---|---|---|---|
| 1a | 0.68 | 1.94 | 1.70 | 1.96 | + |
| 1b | 0.80 | 2.02 | 1.89 | 2.03 | + |
| 2a | 1.57 | 2.09 | 2.05 | – | + |
| 2b | 1.74 | 1.89 | 2.01 | – | + |
| 3a | 1.69 | 1.89 | 1.72 | – | + |
| 3b | 1.71 | 2.00 | 1.76 | – | + |
| 4a | 1.51 | 1.59 | 1.63 | 1.83 | + |
| 4b | 1.35 | 1.67 | 1.59 | 1.85 | + |
| 5a | 1.71 | 1.81 | 1.77 | 1.74 | + |
| 5b | 1.76 | 1.73 | 1.84 | 1.63 | + |
| 6a | 0.91 | 1.74 | 1.77 | 1.89 | +– |
| 6b | 0.91 | 1.82 | 1.76 | 1.88 | + |

Sticking:
+ no sticking
+– slight sticking
– sticking

We claim:

1. Dye acceptor element for the thermal sublimation printing process, having a base and a dye acceptor layer which is located thereon and contains a polyester formed from diols and dicarboxylic acids, wherein 0.5 to 60 mol% of the diol component of the polyester consists of one or more dialkyl-substituted diols having 24 or more carbon atoms and optionally containing a saturated, unsaturated or aromatic ring.

2. Dye acceptor element according to claim 1, wherein the polyester has been formed from aromatic dicarboxylic acids.

3. Dye acceptor element as claimed in claim 1, wherein at least one of terephthalic acid, isophthalic acid and sulphoisophthalic acid, optionally in the form of a derivative selected from the group consisting of a salt, an acid chloride and an ester of said acids, is used as the aromatic dicarboxylic acid and that ethylene glycol is used as an additional constituent of the diol component.

4. Dye acceptor element according to claim 1, wherein the polyester contains solubilising groups.

5. Dye acceptor element according to claim 1, wherein the polyester has been formed from aromatic dicarboxylic acids.

6. Dye acceptor element according to claim 1, wherein the polyester contains solubilising groups.

7. Dye acceptor element according to claim 2, wherein the polyester contains solubilishing groups.

8. Dye acceptor element according to claim 3, wherein the polyester contains solubilising groups.

* * * * *